US007243454B1

(12) United States Patent
Cahill

(10) Patent No.: US 7,243,454 B1
(45) Date of Patent: Jul. 17, 2007

(54) INTEGRATED PRESSURE SWITCH POCKET FOR A VERTICAL FORE GRIP

(75) Inventor: Jeffrey M. Cahill, Anaheim, CA (US)

(73) Assignee: Tango Down, LLC, La Verne, CA (US)

( * ) Notice: Subject to any disclaimer, the term of this patent is extended or adjusted under 35 U.S.C. 154(b) by 0 days.

(21) Appl. No.: 11/394,845

(22) Filed: Mar. 31, 2006

Related U.S. Application Data

(60) Provisional application No. 60/667,578, filed on Apr. 2, 2005.

(51) Int. Cl.
*F41C 23/00* (2006.01)

(52) U.S. Cl. ..... 42/72

(58) Field of Classification Search ..... 42/71, 42/72, 73; 89/1.42
See application file for complete search history.

(56) References Cited

U.S. PATENT DOCUMENTS 5,435,091 A * 7/1995 Toole et al. ..... 42/117
6,023,875 A * 2/2000 Fell et al. ..... 42/146
2005/0188588 A1* 9/2005 Keng ..... 42/72
2005/0241206 A1* 11/2005 Teetzel et al. ..... 42/72
2006/0191183 A1* 8/2006 Griffin ..... 42/72

* cited by examiner

*Primary Examiner*—Michelle Clement
*Assistant Examiner*—Benjamin P. Lee
(74) *Attorney, Agent, or Firm*—Christie, Parker & Hale, LLP

(57) ABSTRACT

A vertical fore grip for a firearm with an integrated pressure switch pocket. The vertical fore grip includes a body with internal storage cavity, a mount adapted to secure a firearm, a pocket for a pressure switch on the perimeter of the body, and a cap to secure a pressure switch and waterproof the internal storage cavity. The mount has a groove for a firearm rail, at least one locking bar, and a spring for engaging the locking bar to a firearm rail.

8 Claims, 21 Drawing Sheets

10
23
14b
14b
14a
14
15b
15a
22
15b
15a
27
27
14b
14b
14a
14
15
15
12

14b
14
14b
14a

INTEGRATED PRESSURE SWITCH POCKET FOR A VERTICAL FORE GRIP

CROSS-REFERENCE TO RELATED APPLICATION(S)

This application claims the benefit of U.S. Provisional Application Ser. No. 60/667,578, filed Apr. 2, 2005, which is incorporated herein by reference.

FIELD OF THE INVENTION

This invention relates to a grip, and more particularly, to a vertical grip and/or a firearm with a vertical grip with an integrated pressure switch pocket and storage.

BACKGROUND OF THE INVENTION

Modern firearms often require mounting and quickly shedding mission-specific accessories that accelerate soldier performance at a given combat task. One of those accessories that has proven invaluable in improving operator control and performance during sustained automatic fire is the vertical fore grip.

The current fore grip design is a glass-filled polypropylene component that can be uncomfortable to most hands. Many operators feel that the grip diameter is too small and requires considerable grasp pressure to prevent slippage. The material itself is waxy to the touch, and becomes even slicker when wet or sweaty. It also prevents proper adhesion of glues for pressure switches, resulting in less-than-satisfactory switch mounting methods. This grip has no form of hand retention other than small grooves at the grip end which easily pack with dirt or mud, eliminating any benefit.

Another weakness of existing grips is the mounting system. A small cylindrical soft plastic projection is the sole method of retaining the grip to the rail system. Any major impact to the grip shears the projection, allowing the firearm to slide out of control in an operator's hand. Field expedient fixes have been to drill out the sheared plastic part and replace it with a steel pin. This is time consuming and a stop-gap improvement.

SUMMARY OF THE INVENTION

In one embodiment, the invention is a vertical fore grip for attachment to a firearm. The grip includes a body having an internal storage cavity with an external opening, a mount adapted to secure a firearm, the mount located at one end of the body, a pocket adapted to receive a pressure switch on the perimeter of the body, and a removable cap, adapted to cover the external opening. In another embodiment, the mount includes a rail groove, at least one locking bar dimensioned to interface with cross cuts in a firearm rail, a spring engaging the body and the locking bar, and at least one slot having an upper portion and a lower portion, the slot dimensioned to accept a locking bar substantially in the upper portion while engaged or substantially in the lower portion in a released condition, the slot protruding through the housing of the grip and running through the rail groove substantially perpendicular to the rail groove.

In one embodiment, the invention is firearm that includes a vertical fore grip. The fore grip includes a body having an internal storage cavity with an external opening, a mount adapted to secure a firearm, the mount located at one end of the body, a pocket adapted to receive a pressure switch on the perimeter of the body, and a removable cap adapted to cover the external opening.

DETAILED DESCRIPTION OF THE INVENTION

As illustrated in FIGS. 1-10, embodiments of the invention are directed to a vertical fore grip for a firearm having an internal storage cavity and a pressure switch pocket.

Figure 1:
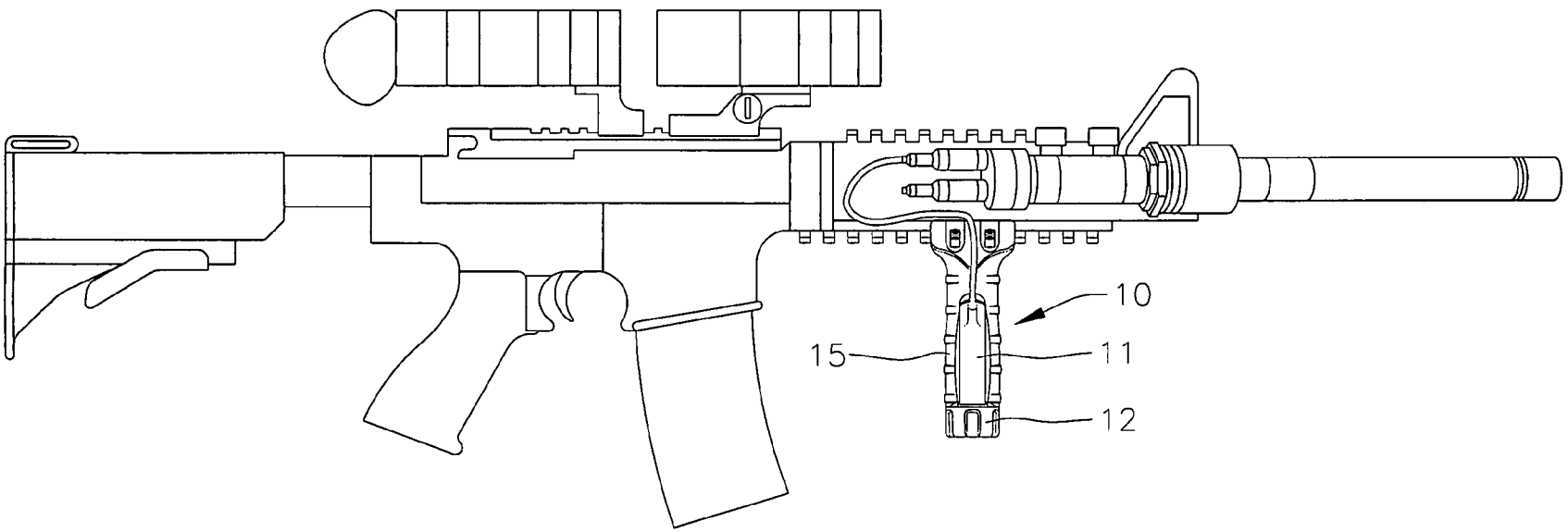
FIG. 1 is a side view of a firearm with a vertical grip and pressure switch according to one embodiment of the invention.
Figure 2:
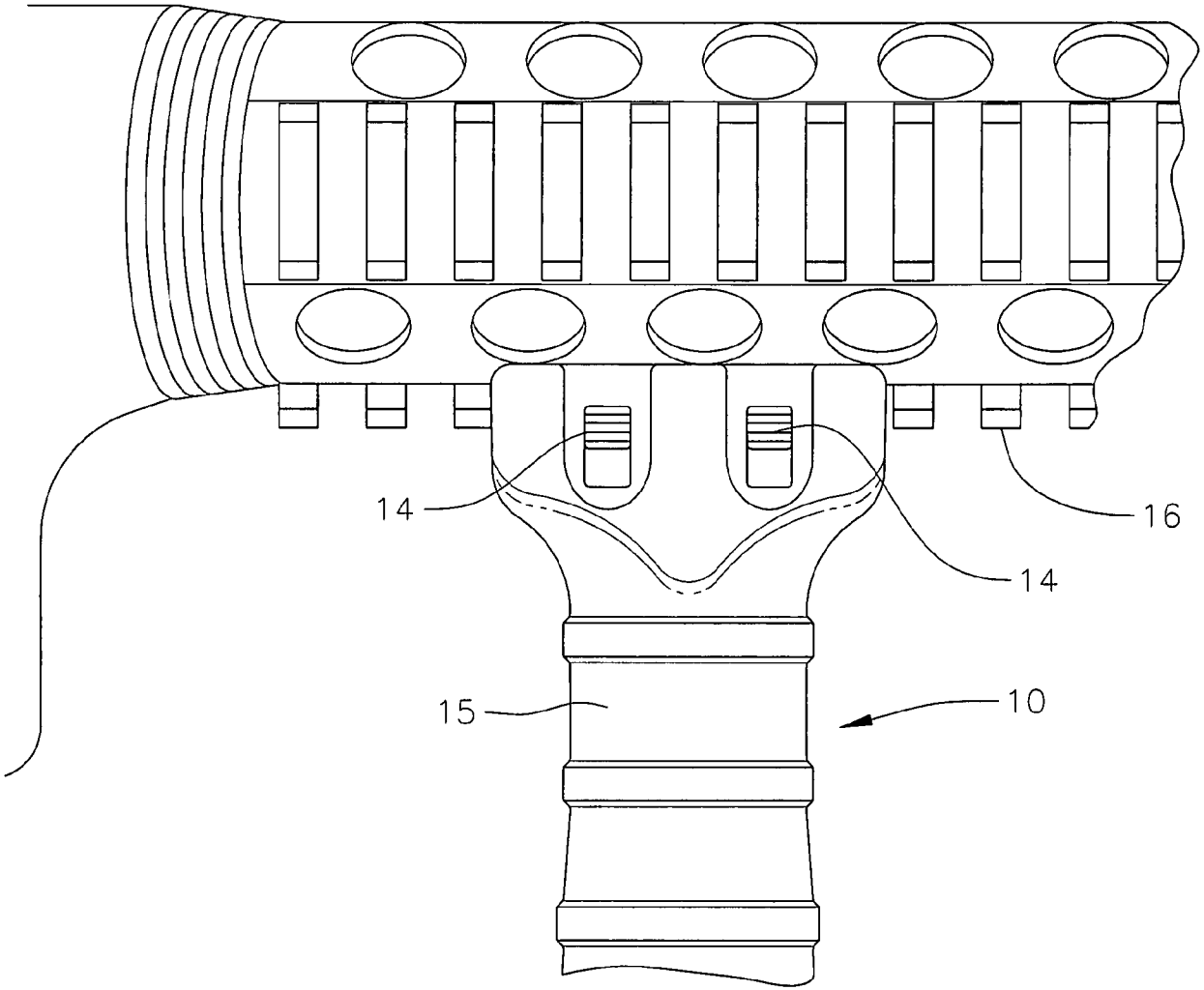
FIG. 2 is a side view of a vertical fore grip mounted on a Mil-Std-1913 rail according to one embodiment of the invention.

FIG. 1 shows a vertical fore grip 10 with pressure switch 11 installed on a firearm according to one embodiment of the invention. The pressure switch 11 is held in place by cap 12. Vertical fore grips 10 are often called upon to mount pressure switches for lasers and tactical lights. FIG. 2 shows a vertical grip 10 with locking bars 14 engaged in a Mil-Std-1913 rail on a firearm according to one embodiment of the invention. As discussed in detail below, in an embodiment, the vertical fore grip 10 includes a body 15, the upper portion of which is the mount, the body 15 having a cap 12 attached thereto, which removably covers an internal cavity of the body 15, and a pressure switch pocket 18, and removable cavity filler panel 13, as shown in FIGS. 3A,B.

Figure 3A:
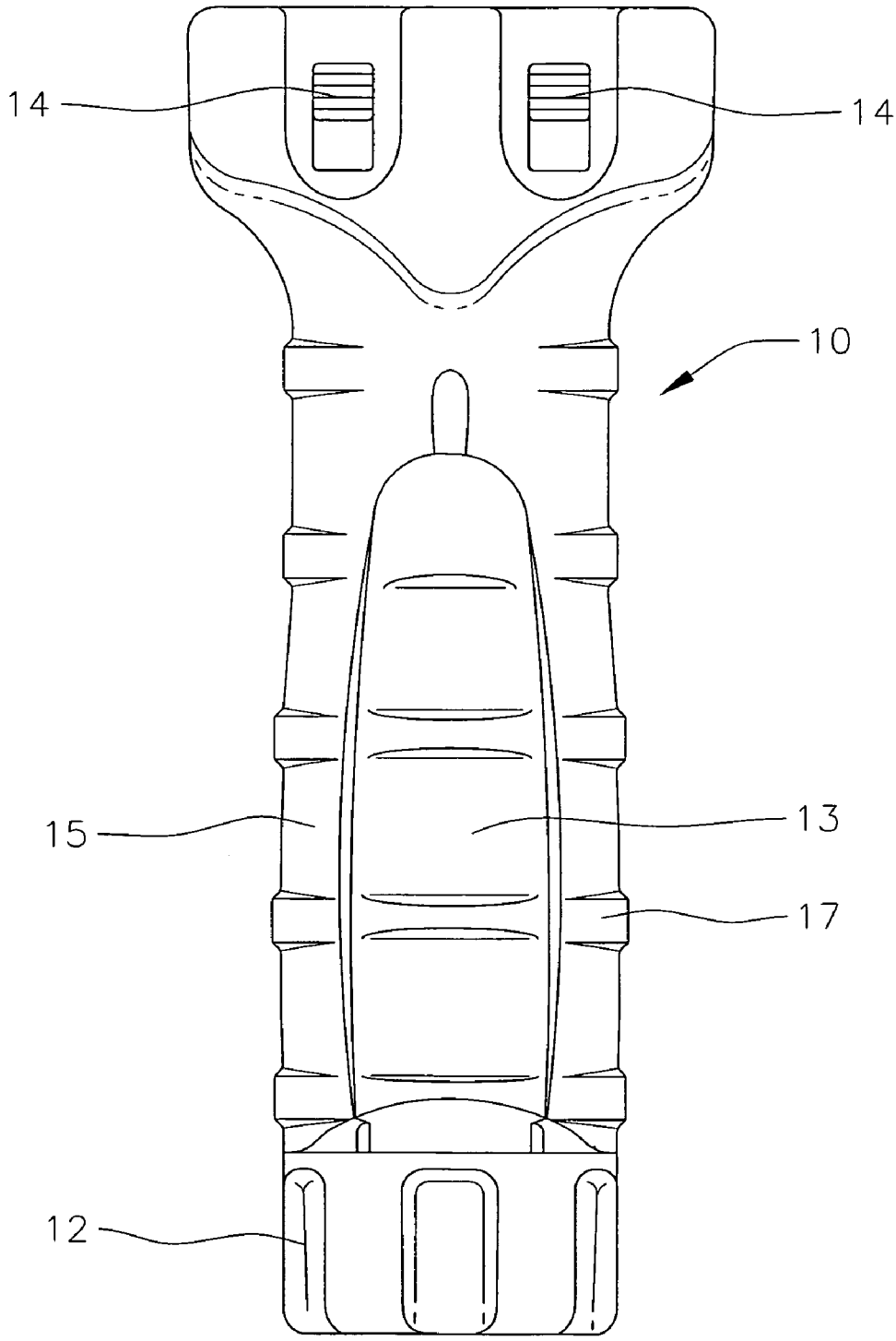
FIG. 3A is a side view of the vertical fore grip with the pressure switch cavity filler panel installed according to one embodiment of the invention.

In the embodiment of FIG. 3A, the body 15 has a removable pressure switch cavity filler panel 13 installed. The body 15 is generally cylindrical in shape in one embodiment. This allows the operator to rotate his firearm around barriers without a shift in grip. In an embodiment, the body 15 also has smooth shape devoid of sharp edges allow the hand to firmly grasp the vertical fore grip 10 without fatigue. In another embodiment, soft-radius ridges 17 provide maximum retention under full-auto fire. Further, the end cap 12 is easy to manipulate with gloved fingers, in many different weather conditions. Locking bars 14, which are part of the mount, are shown in the resting position. It is possible to use one or more locking bars 14. As shown, dual locking bars 14 provide an interface to a firearm rail that permits simple connection or disconnection without requiring the use of any tools. Once locked, no significant fore-aft movement can take place, even under significant force.

Figure 3B:
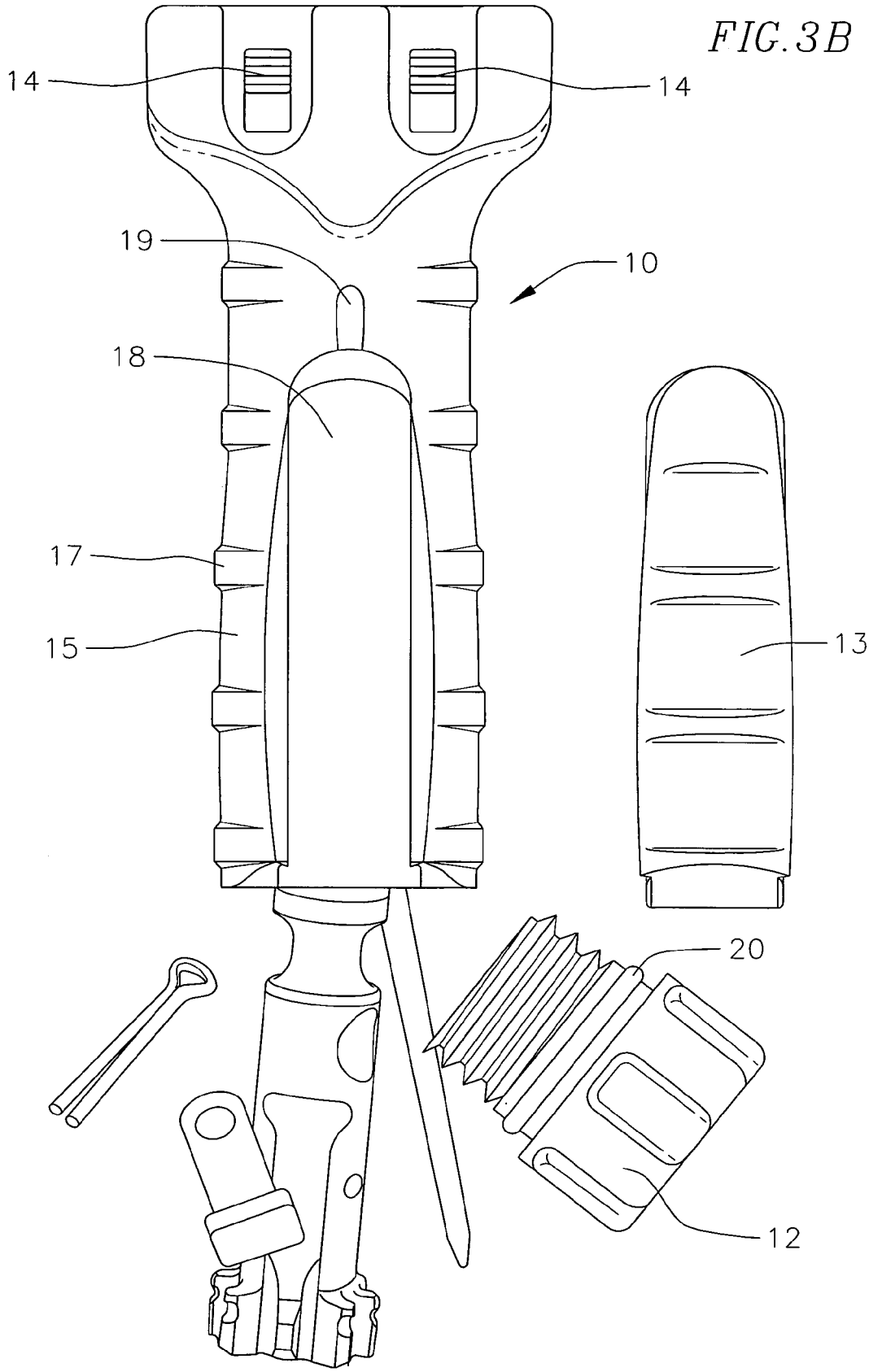
FIG. 3B is a side view of the vertical fore grip with the pressure switch cavity filler panel removed, the cap unscrewed, and tools sliding into the internal storage cavity according to one embodiment of the invention.
Figure 3C:
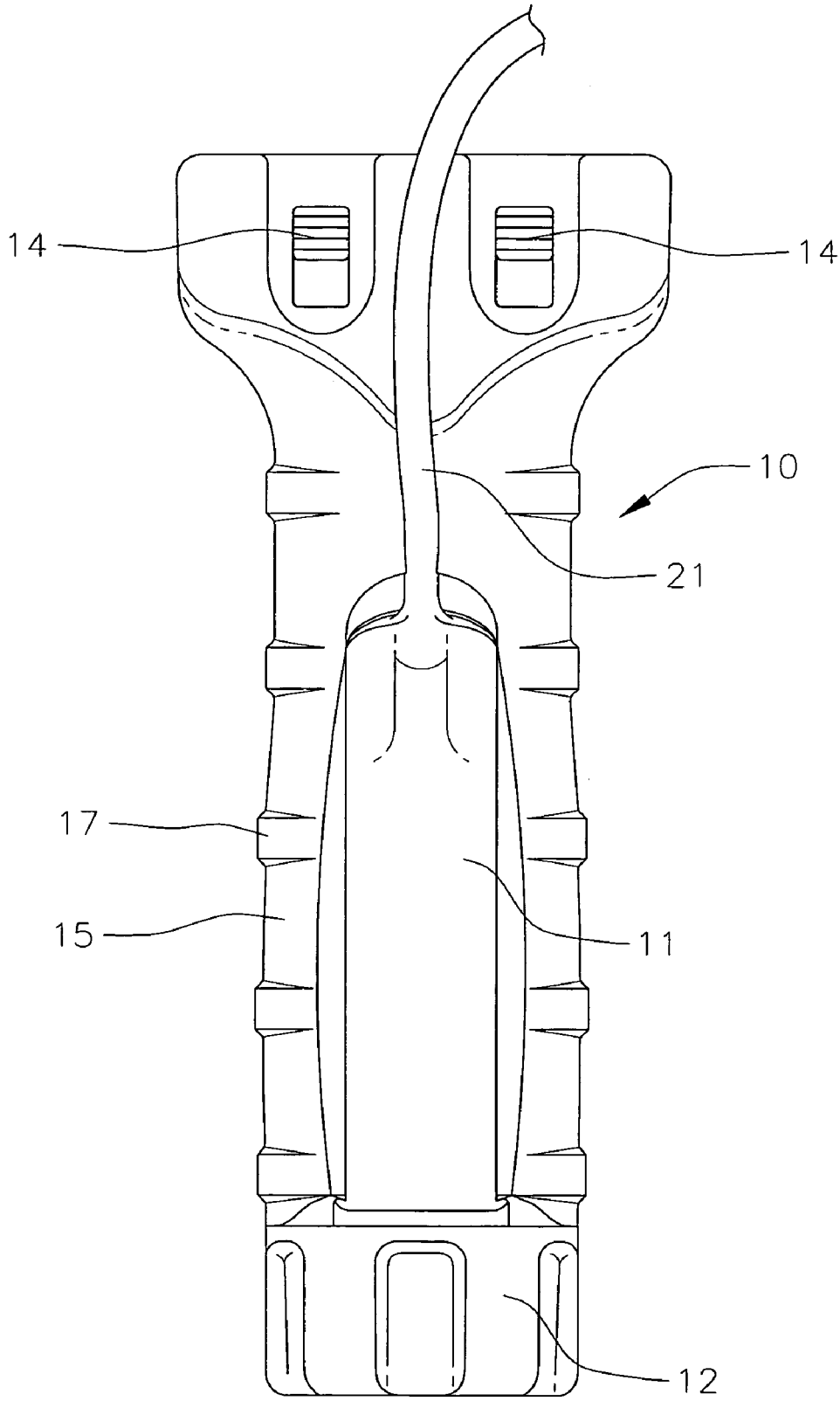
FIG. 3C is a side view of the vertical fore grip with a pressure switch installed according to one embodiment of the invention.
Figure 3D:
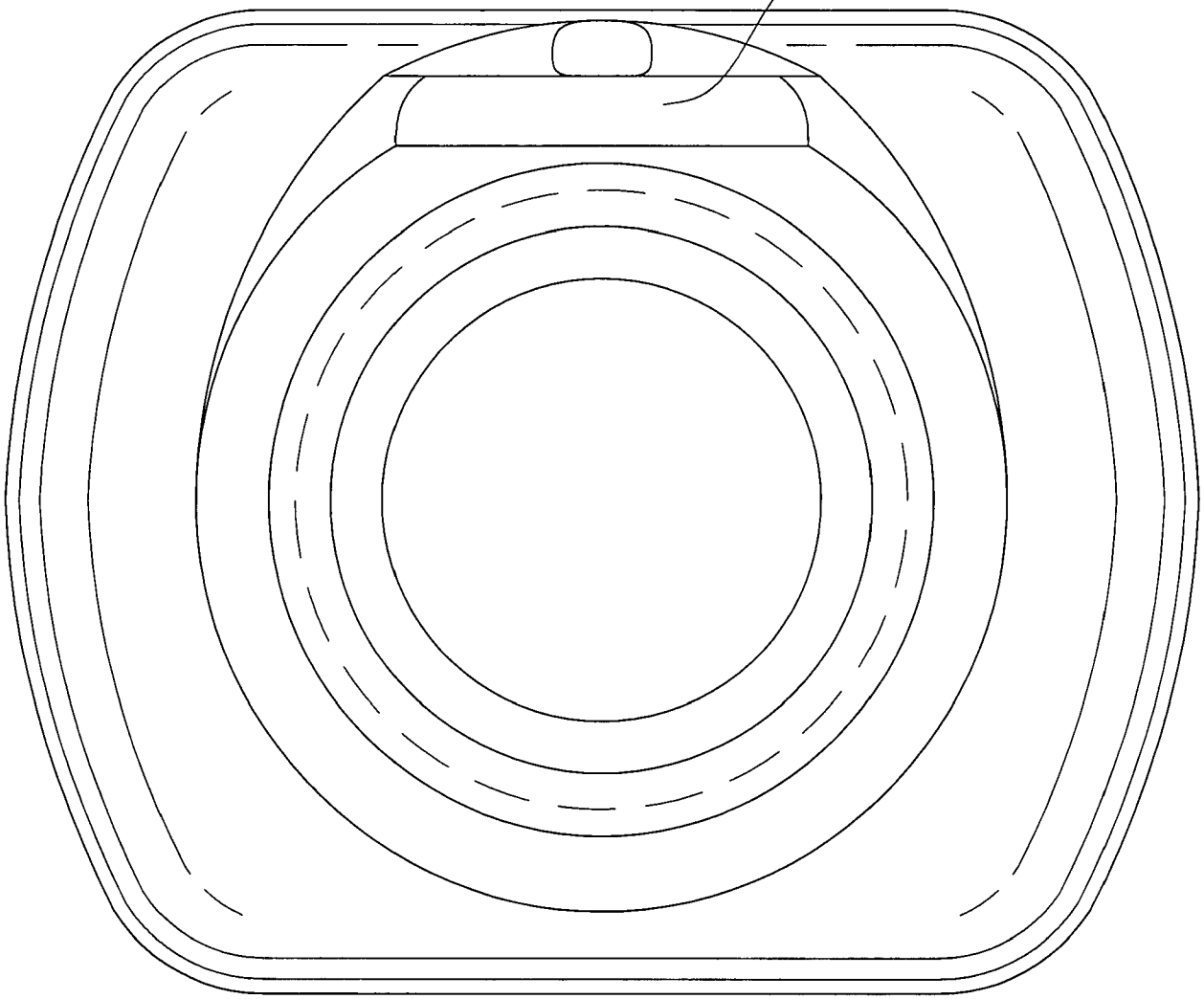
FIG. 3D is an end view of the vertical fore grip showing the dovetail pressure switch pocket according to one embodiment of the invention.

FIG. 3B shows an embodiment of the invention with the filler panel 13 removed from the body 15, thereby exposing a pressure switch pocket 18. There is also a wire harness groove 19, located adjacent to the pressure switch pocket 18. In an embodiment, as seen in FIG. 3D the pressure switch pocket 18 is dove tailed and extends down to the bottom of the body. This allows the cap 12 to lock in a pressure switch 11, as shown in FIG. 3C. In an embodiment, the filler panel 13 has grooves that correspond to the dove tailed pocket 18, allowing it to slide into the pocket and assist in holding the filler panel 13 in the pocket 18. In an embodiment the pocket 18 is sized for a SureFire™ switch such as the switch on light model M951 KIT02, National/NATO Stock No.: 6240-01-532-4184. If a dove tail is not present in the pocket, or if a wider switch than the standard SureFire™ switch is used, such as the Insight Technology, Inc. ITI™ PEQ 5 Switch, then adhesive tape, Velcro™, or similar fastener may be used to secure the body of the switch to the vertical fore grip. For example, rubber bands or alternate elastic materials such inner-tube materials, may hold the switch to the grip. In these alternative mounting situations, the cap may still be used to lock the bottom of the switch in to prevent the switch from sliding down the grip. In one embodiment, the cap 12 is threaded and contains an O-ring 20 to allow a tight seal between the cap 12 and the body 15, thereby facilitating a waterproof storage cavity. FIG. 3B additionally shows tools that may be stored inside the internal storage cavity. FIG. 3C shows the vertical fore grip 10 according to an embodiment, with an installed pressure switch 11. The pressure switch 11 is held in place by the cap 12, and the wire harness 21 lies in groove 19.

Figure 4:
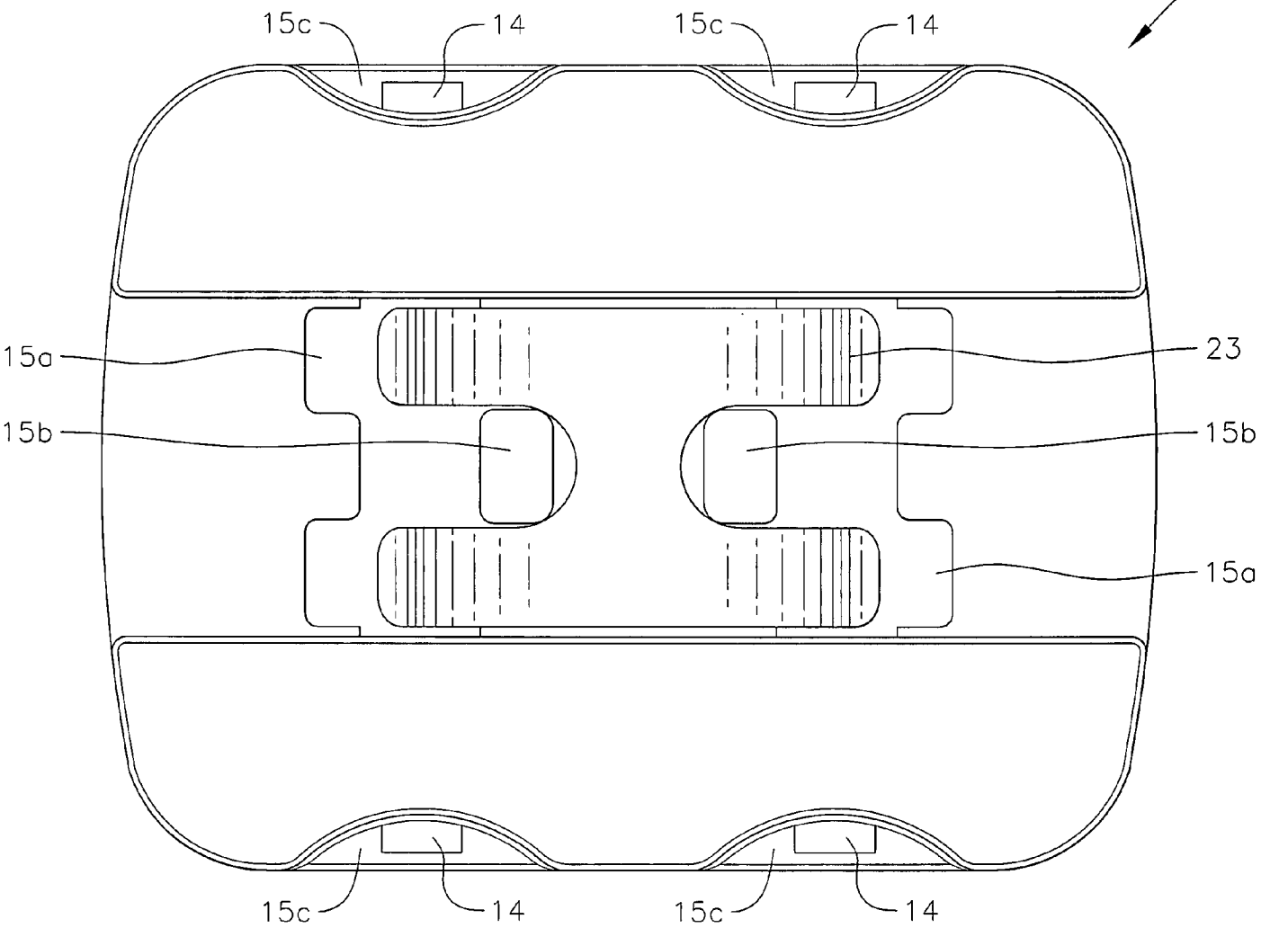
FIG. 4 is an overhead view of the vertical fore grip according to one embodiment of the invention.

Referring to FIG. 4, according to one embodiment, an overhead view of the vertical fore grip 10 shows a spring 23, a recess 15*a* in the top to accept the spring 23, and two posts 15*b* that also assist in orienting the spring 23 and holding it in the recess 15*a*. According to another embodiment, the recesses 15*c* in the fore grip 10 for the locking bars 14 are also shown. These optional recesses 15*c* allow easier access to the locking bars 14, particularly with gloved fingers.

Figure 5A:
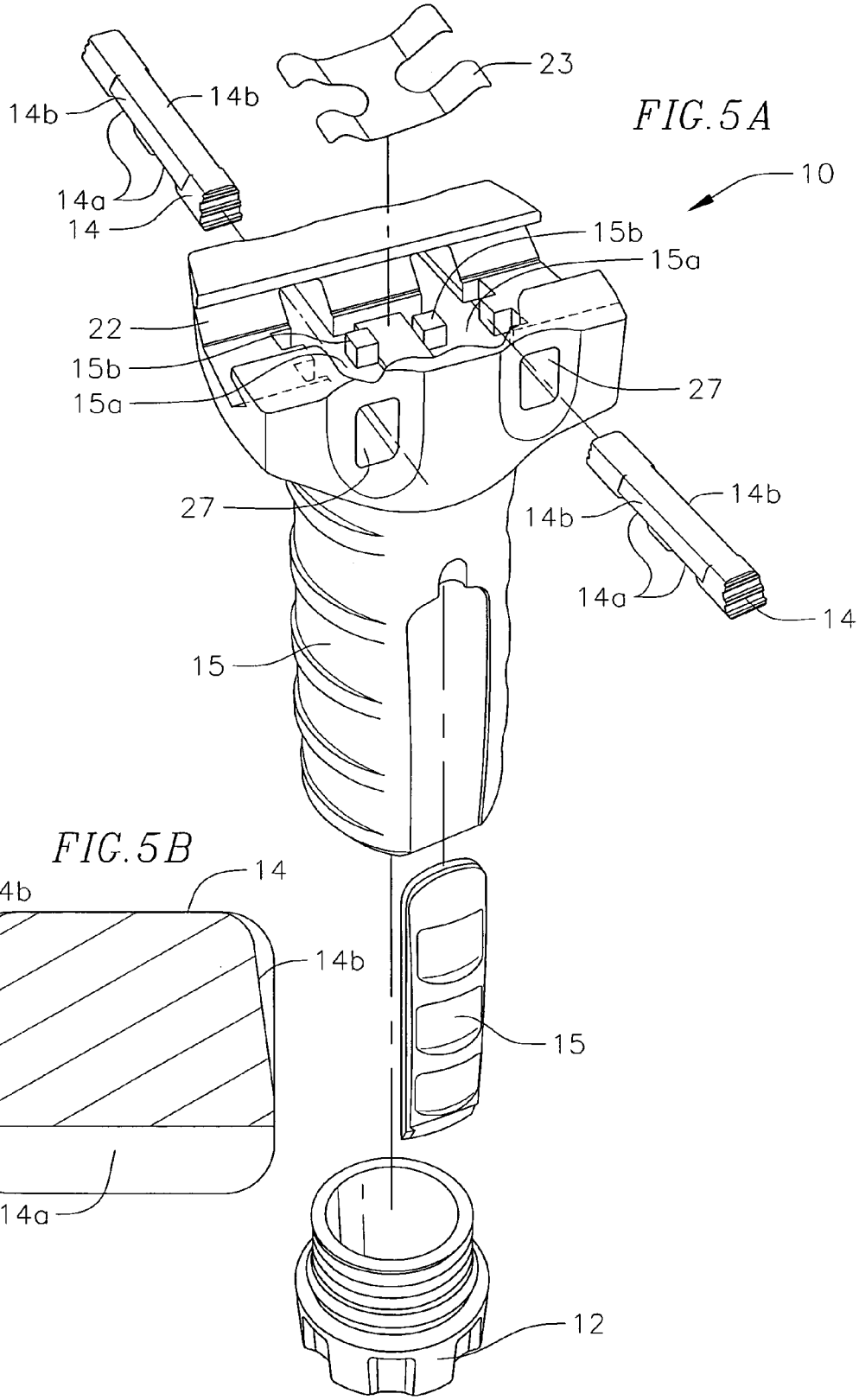
FIG. 5A is an exploded view of the vertical fore grip according to one embodiment of the invention.
Figure 5B:
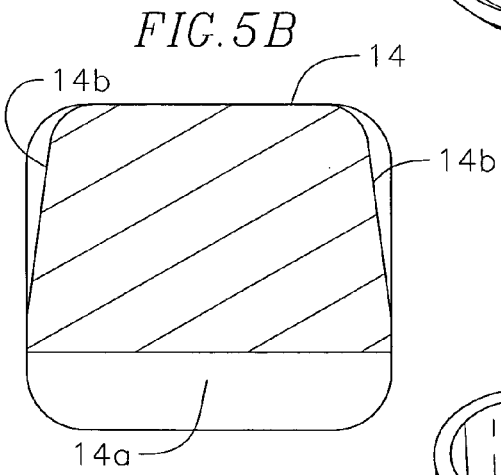
FIG. 5B is cross-sectional view of a locking bar according to one embodiment of the invention.

Referring to FIG. 5A, according to an embodiment, the mount includes the rail groove 22, at least one locking bar 14, the spring 23, and at least one slot 27. In one embodiment, the locking bars 14 are rectangular in shape with sloped ends, the ends having horizontal ridges to allow a better gripping surface. In one embodiment, each locking bar 14 further comprises at least one notch 14*a* along its bottom surface, dimensioned to accept the spring 23. In another embodiment, as shown in FIG. 5B, the locking bars may be made of injection molded resin and are slightly wedge shaped 14*b* in cross section to compensate for wear. In an embodiment, the spring 23 has an "H" shape and is made of heat treated corrosion-proof stainless steel. In a further embodiment, the spring may have an "I" shape similar to a leaf spring, engaging the locking bar at one point. In yet another embodiment, the spring may be an antler spring which is a bent wire with a similar profile to a staple where the ends of the wire curl toward the center of the wire after a stapler has attached it to paper, with a different wire for each notch 14*a* of the locking bar. The spring design is not limited to the embodiments above.

Figure 6:
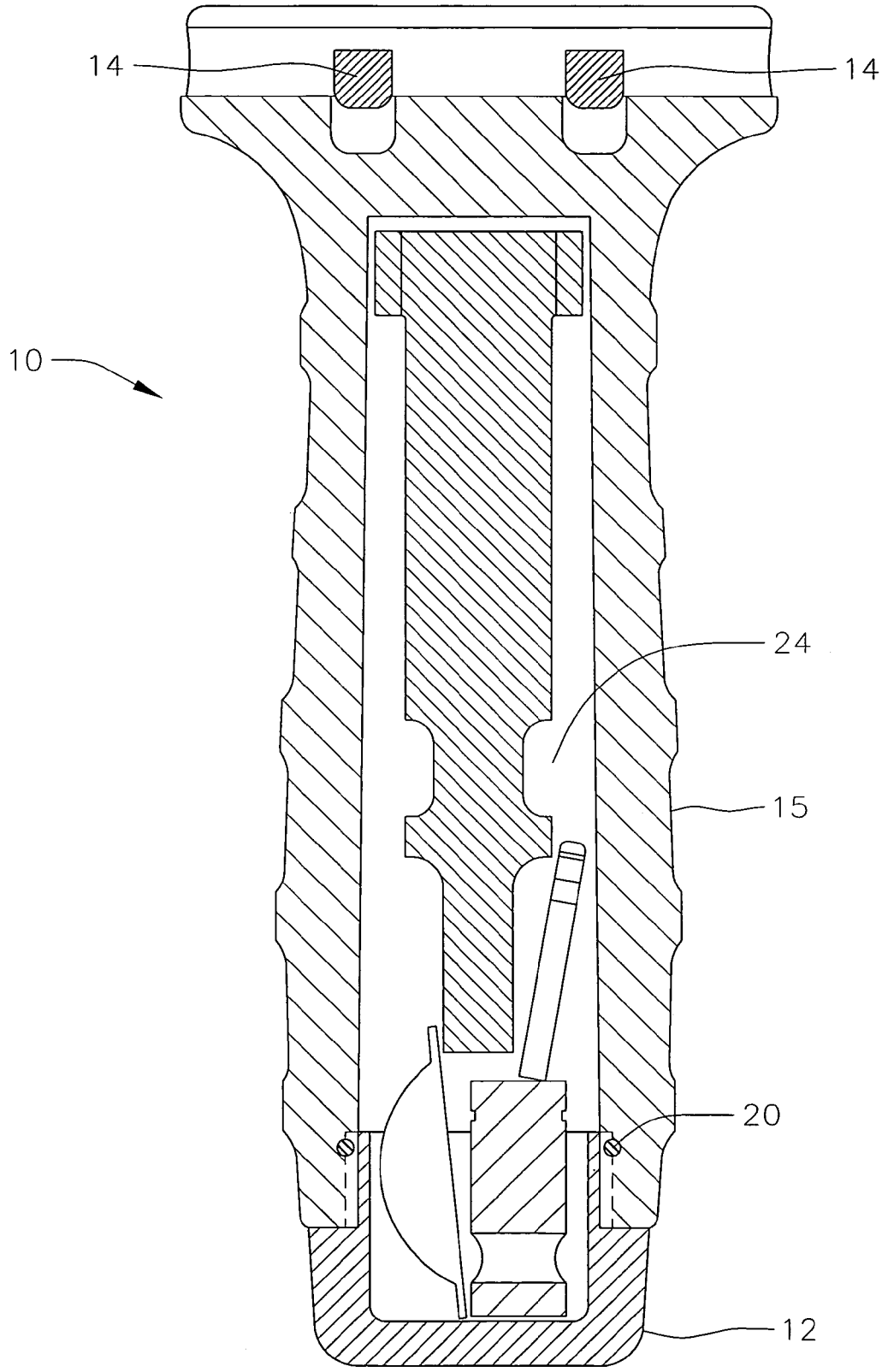
FIG. 6 is a side cross-sectional view of the vertical fore grip with tools stored in the internal storage cavity according to one embodiment of the invention.

FIG. 6 is a cross-sectional view of the vertical fore grip 10 according to an embodiment of the invention. The internal cavity 24 can accept tools and is waterproof if used with cap 12 and the O-ring 20.

Figure 7A:
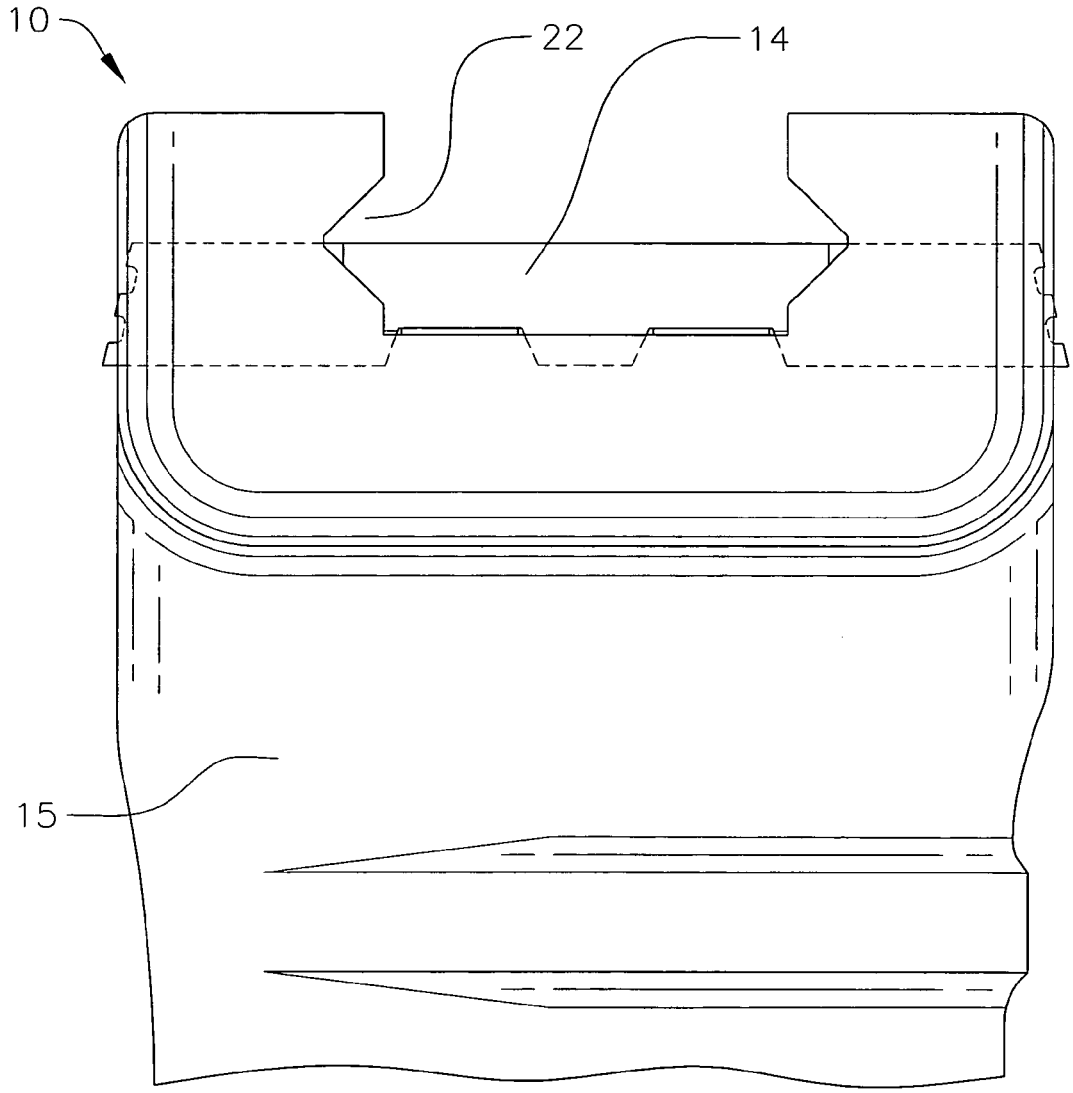
FIG. 7A is an end view of the vertical fore grip with the locking bars in the resting position according to one embodiment of the invention.
Figure 7B:
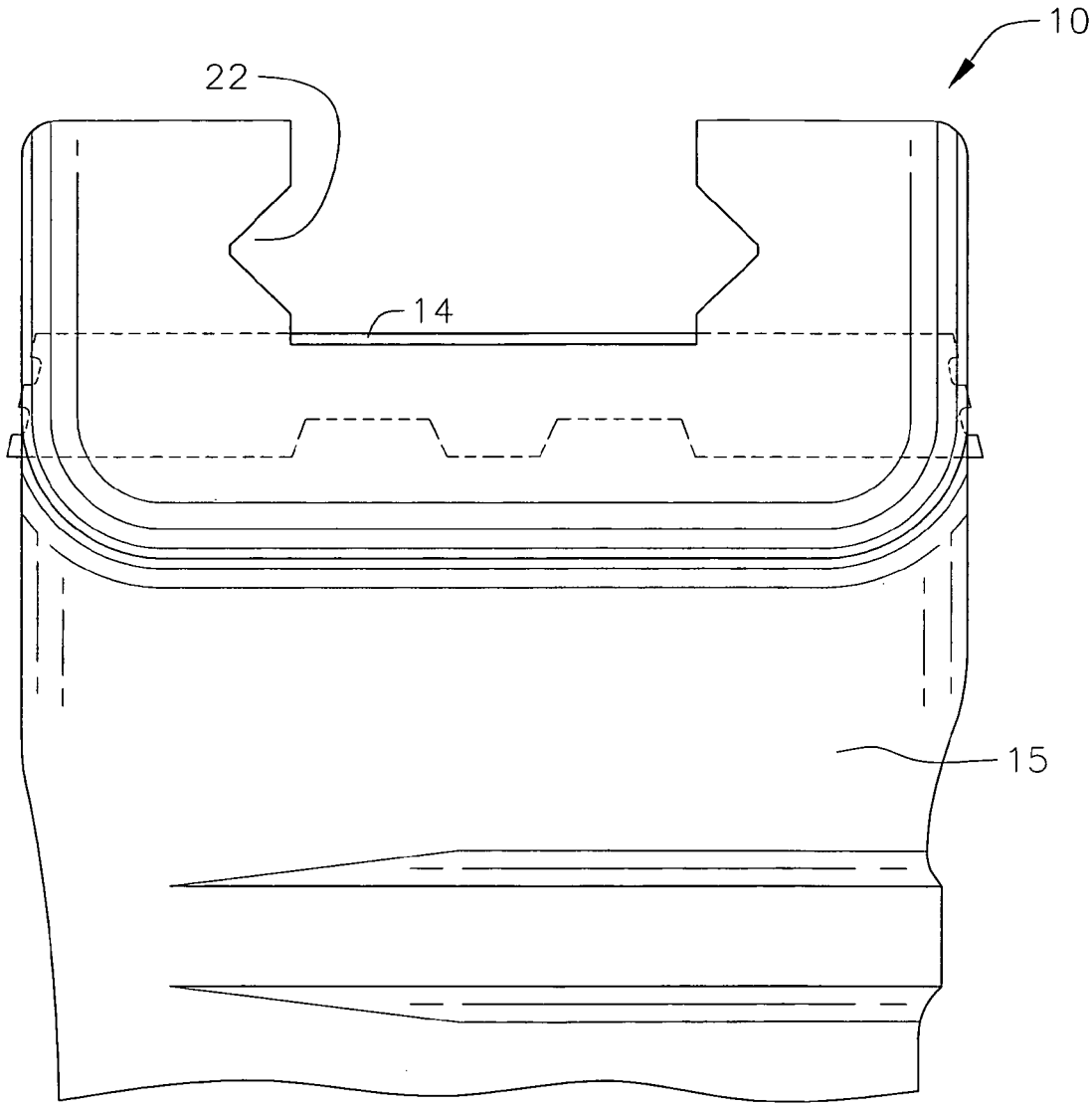
FIG. 7B is an end view of the vertical fore grip with the locking bars in the retracted position according to one embodiment of the invention.
Figure 7C:
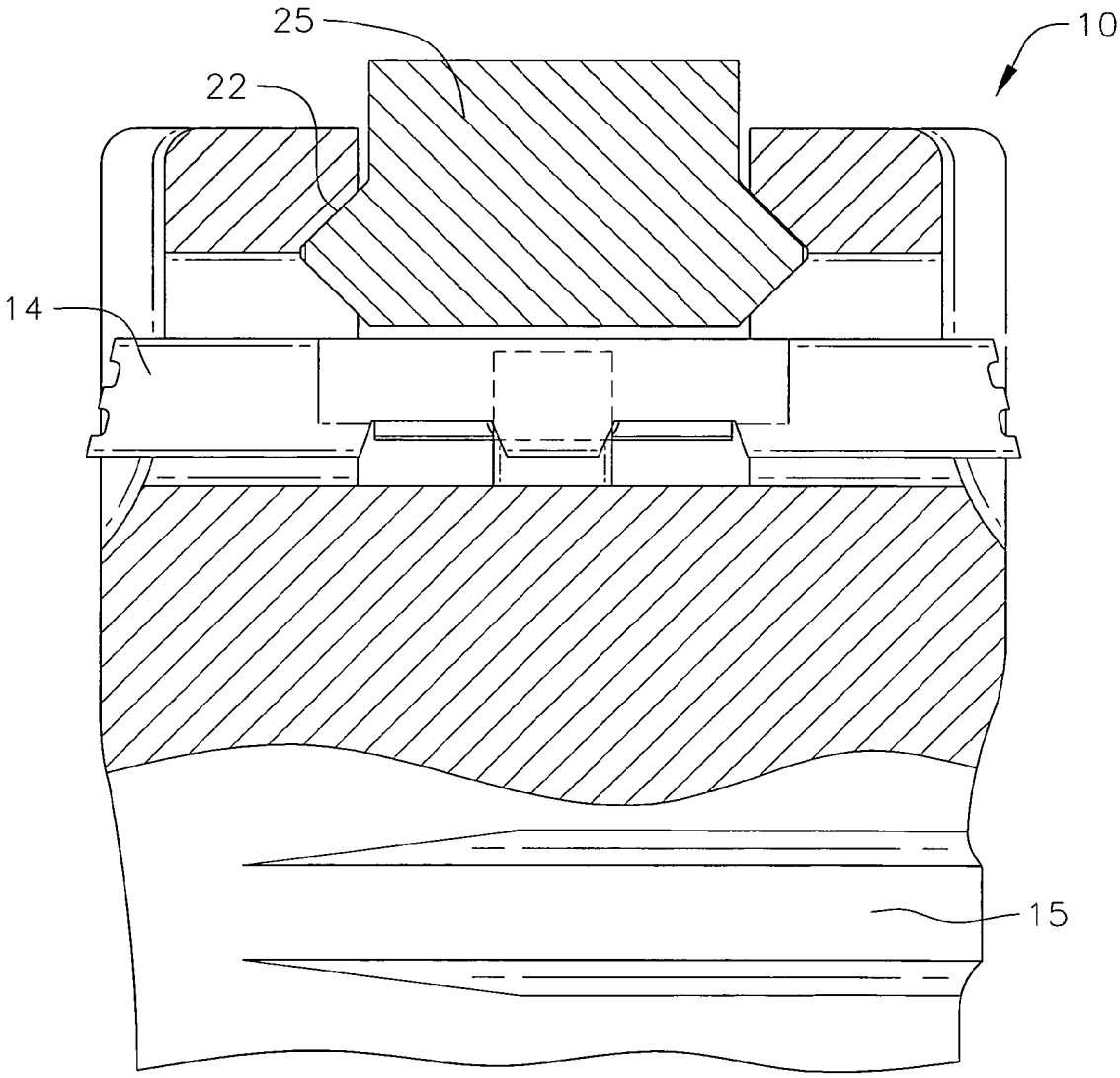
FIG. 7C is a cross-sectional end view of the vertical fore grip and firearm rail with the locking bars in the retracted, non-locked, position according to one embodiment of the invention.
Figure 7D:
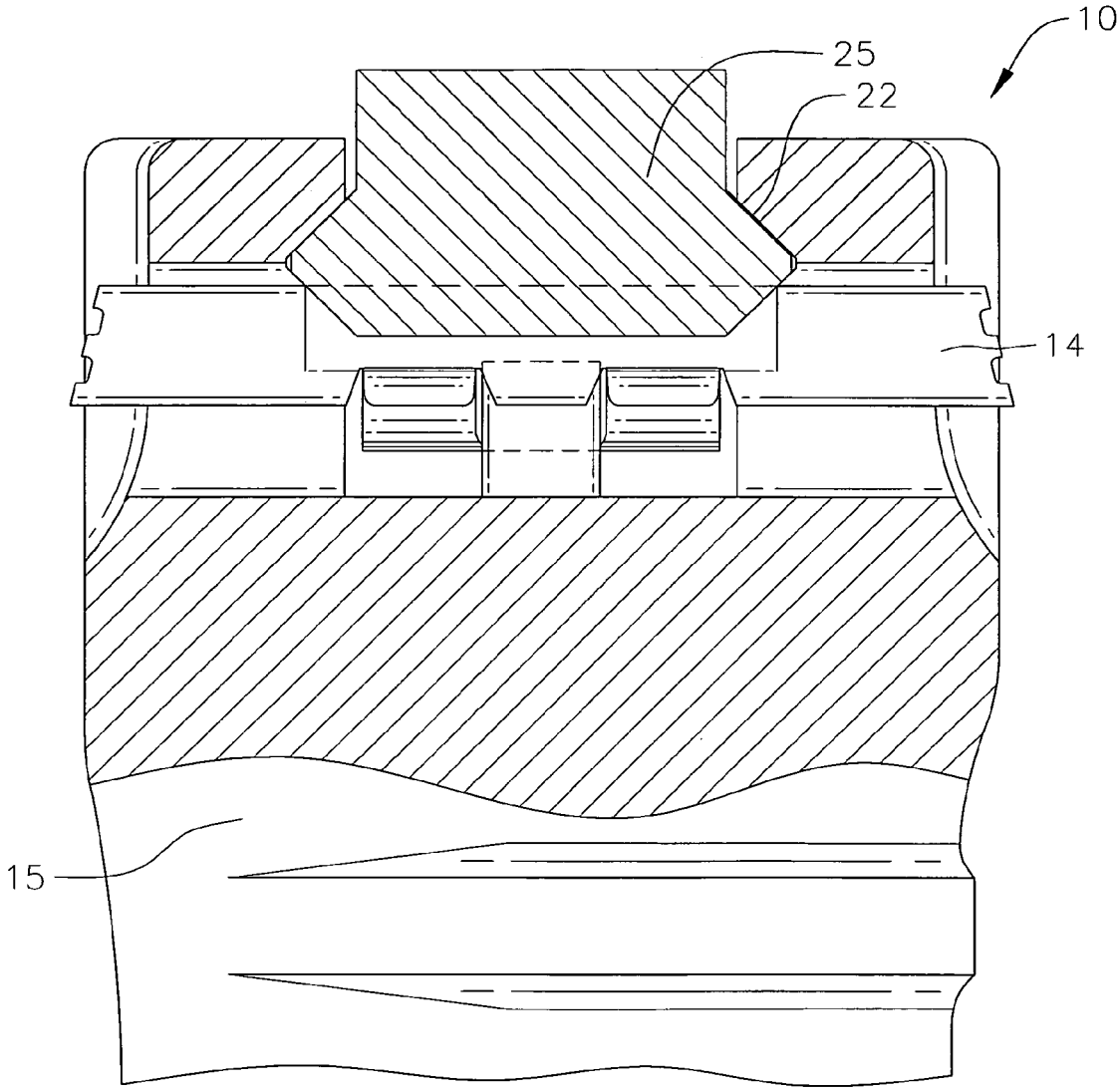
FIG. 7D is a cross-sectional end view of the vertical fore grip and firearm rail with the locking bars in the resting, locked, position according to one embodiment of the invention.

FIG. 7A is a front view of the vertical fore grip 10 according to an embodiment of the invention. A locking bar 14, is shown in the resting position without an installed firearm rail in the rail slot 22. FIG. 7B shows the locking bar 14 in a retracted position without an installed firearm rail, according to an embodiment of the invention. FIG. 7C is a front cross-sectional view showing a locking bar 14 in a retracted position and a firearm rail 25 in the rail slot 22 according to an embodiment. FIG. 7D is a front cross-sectional view illustrating a locking bar in a locked position with the firearm rail 25 in the rail slot 22 according to one embodiment of the invention.

Figure 8A:
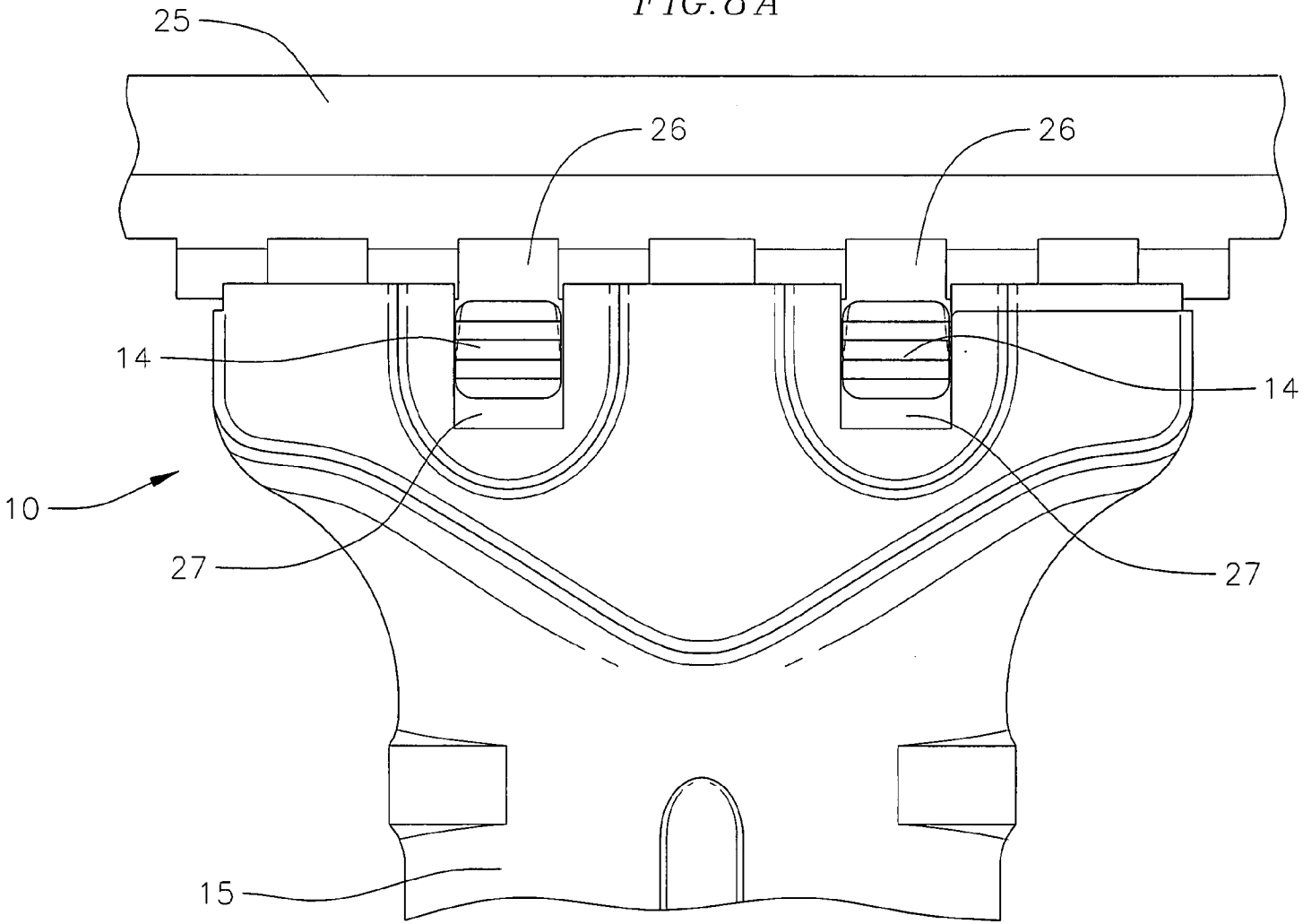
FIG. 8A is a side view of the vertical fore grip and firearm rail with the locking bars in the retracted, non-locked, position, and the portion above the locking bar slots removed according to one embodiment of the invention.
Figure 8B:
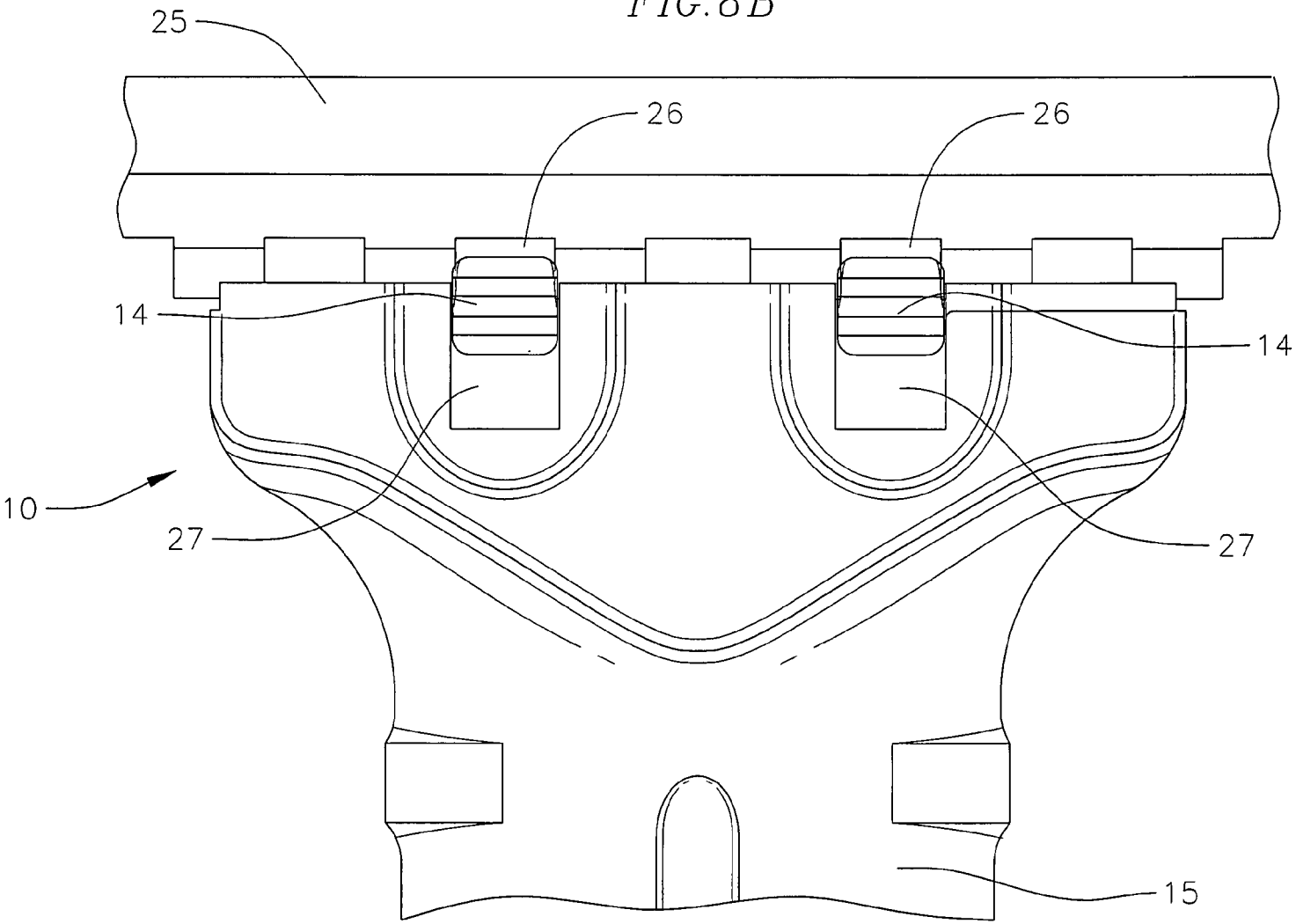
FIG. 8B is a side view of the vertical fore grip and firearm rail with the locking bars in the resting, locked, position and the portion above the locking bar slots removed according to one embodiment of the invention.
Figure 8C:
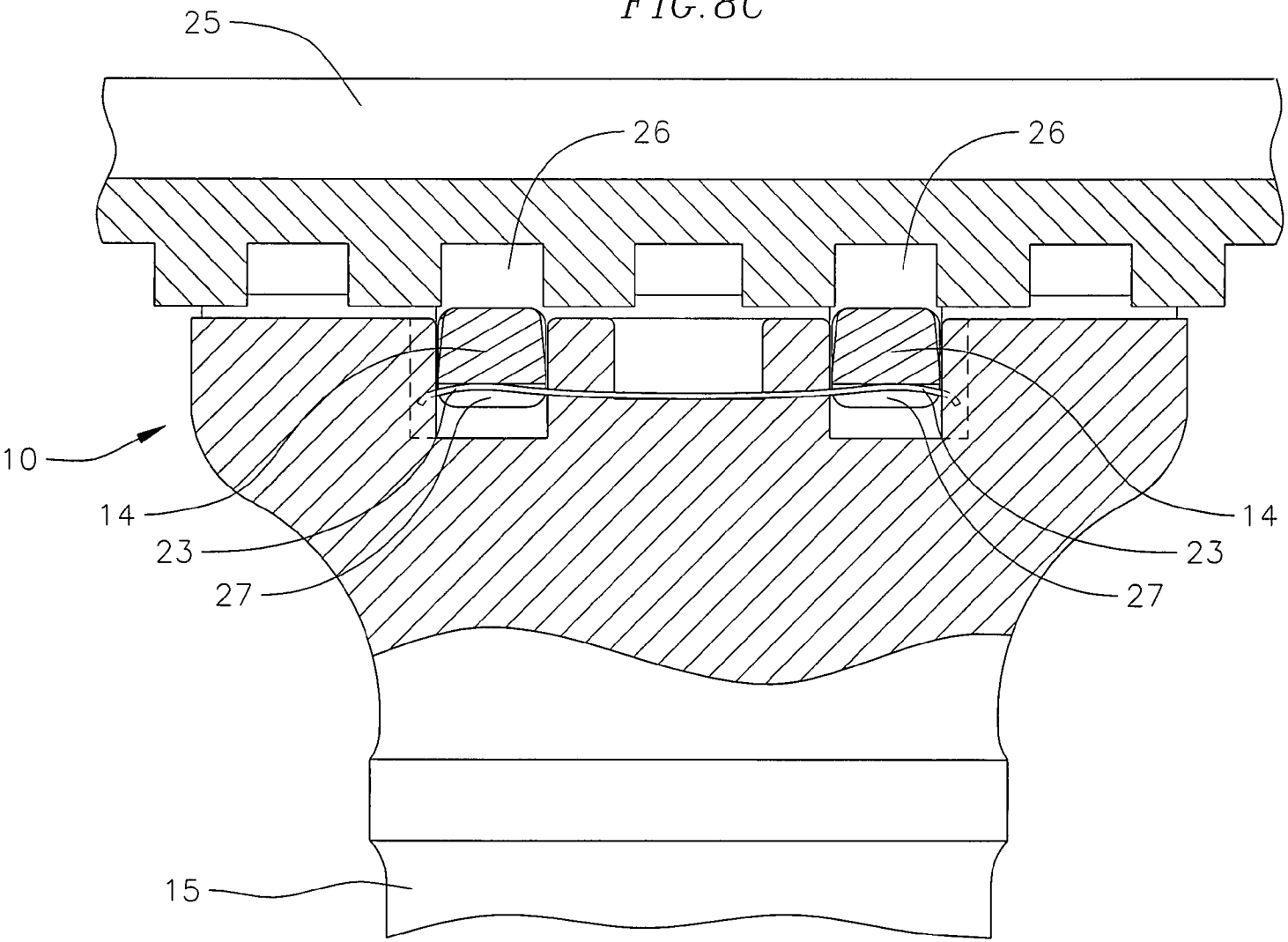
FIG. 8C is a cross-sectional side view of the vertical fore grip and firearm rail with the locking bars in the retracted, non-locked, position according to one embodiment of the invention.
Figure 8D:
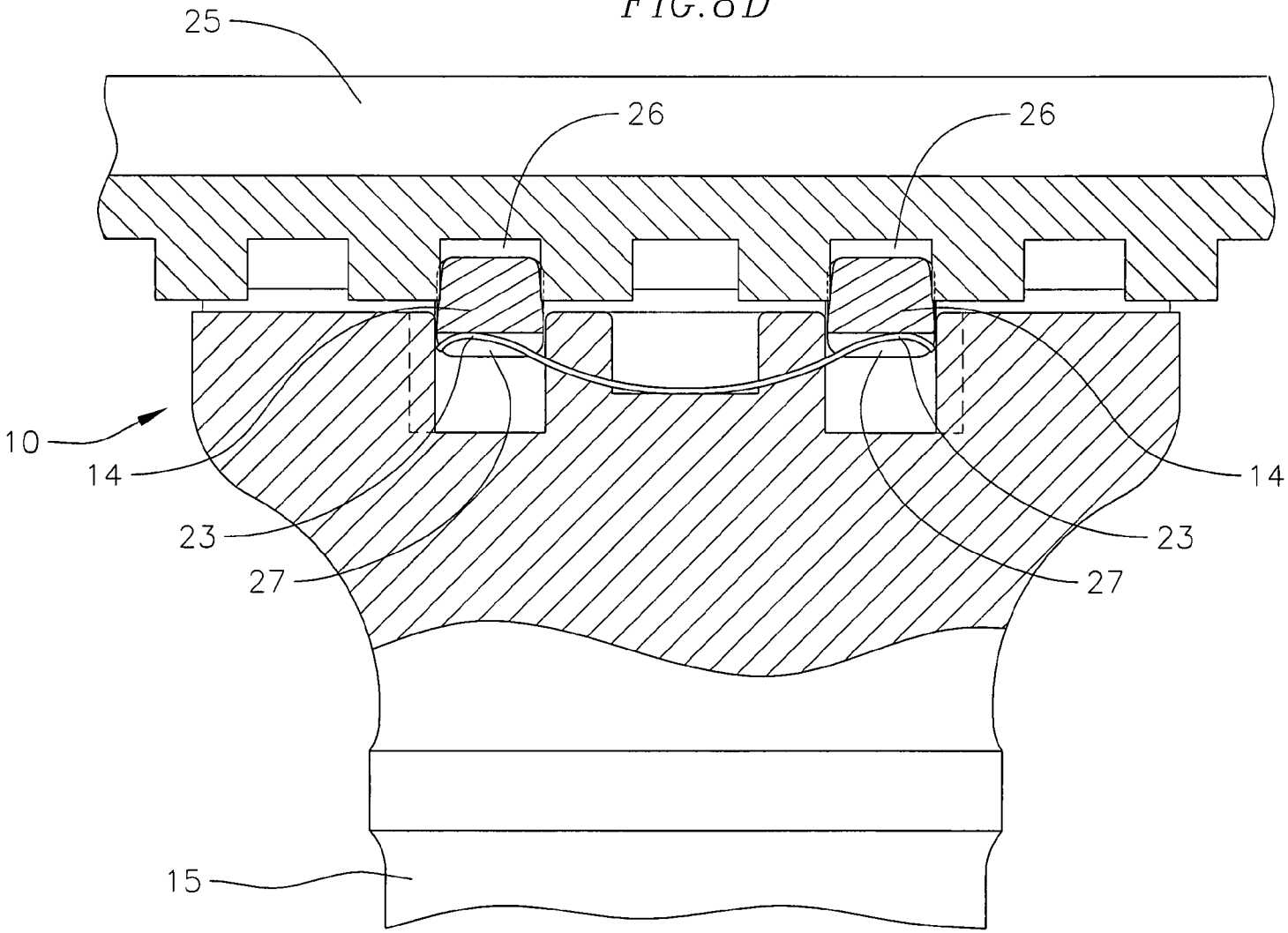
FIG. 8D is a cross-sectional side view of the vertical fore grip and firearm rail with the locking bars in the resting, locked, position according to one embodiment of the invention.

FIGS. 8A and 8C are side views of the vertical fore grip 10 and an installed firearm rail 25 with the locking bars 14 in a depressed, non-locked, position according to one embodiment. The locking bars 14 are at the bottom of the slot 27 and thus have not engaged the cross cuts 26 on the firearm rail 25. FIGS. 8B and 8D show the locking bars 14 within the cross cuts 26 of the firearm rail 25, thereby locking the vertical fore grip 10 to the firearm rail 25 according to one embodiment. The locking bars 14 are near the top of the slots 27 when they have engaged the firearm rail 25. Note that only one locking bar 14 is necessary, but two, three, or more may also be used.

Figure 9A:
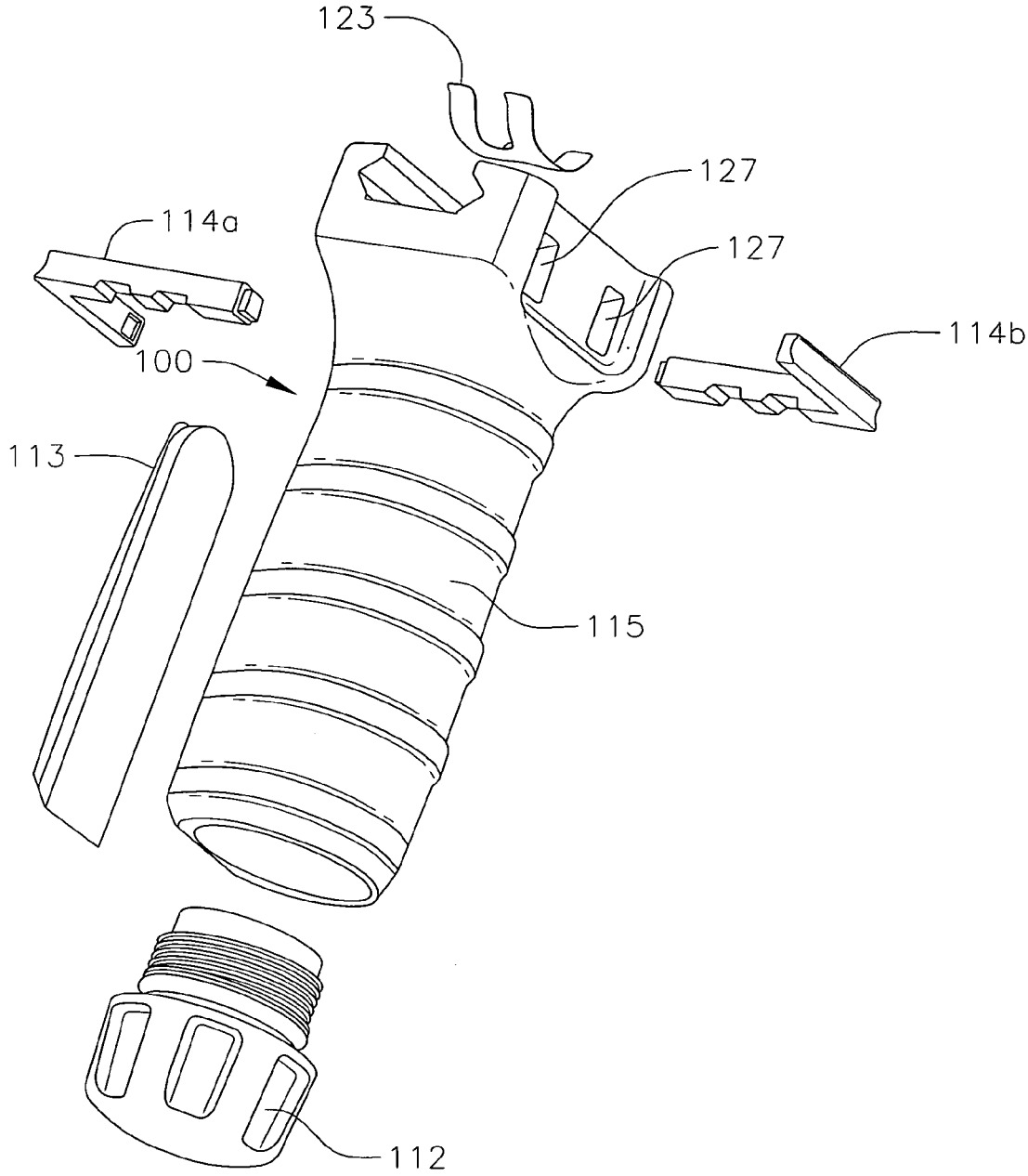
FIG. 9A is an exploded view of the vertical fore grip and "L" shaped locking bars according to one embodiment of the invention.
Figure 9B:
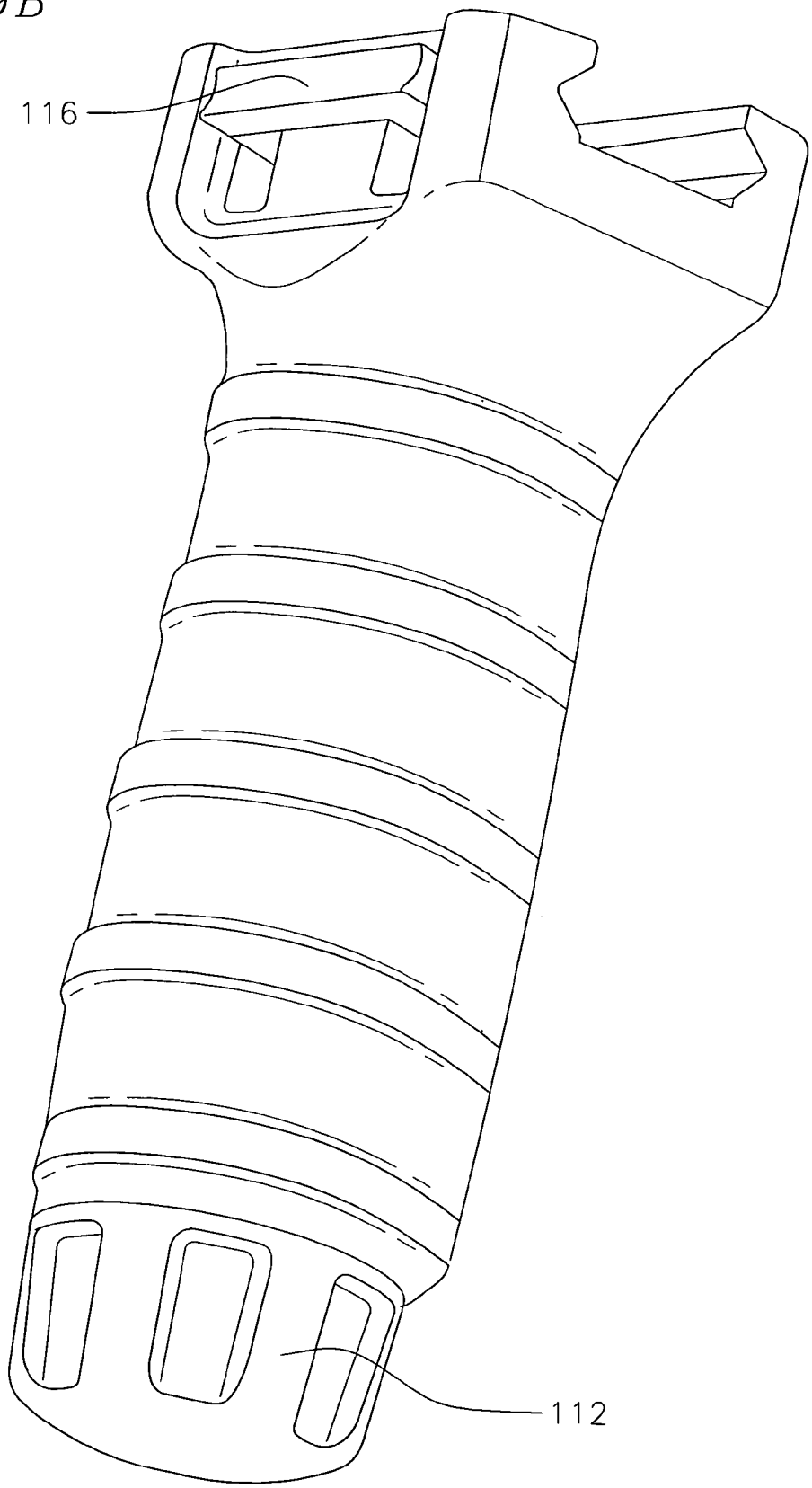
FIG. 9B is a perspective view of the vertical fore grip and "L" shaped locking bars according to one embodiment of the invention.
Figure 9C:
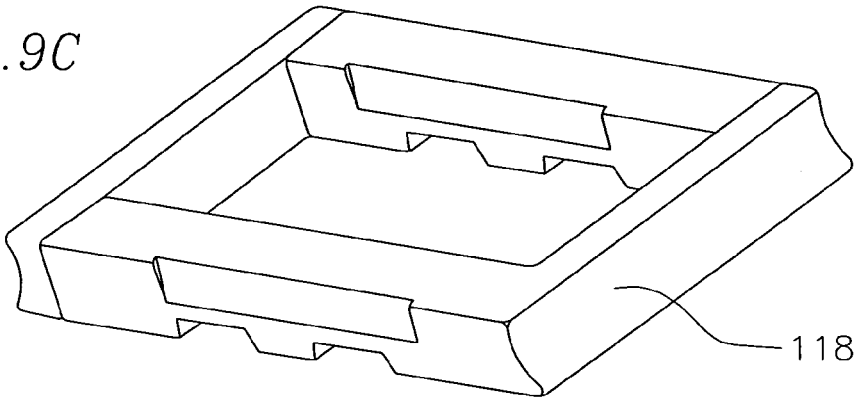
FIG. 9C is an assembled perspective view of a "U" shaped locking bar assembly according to one embodiment of the invention.
Figure 9D:
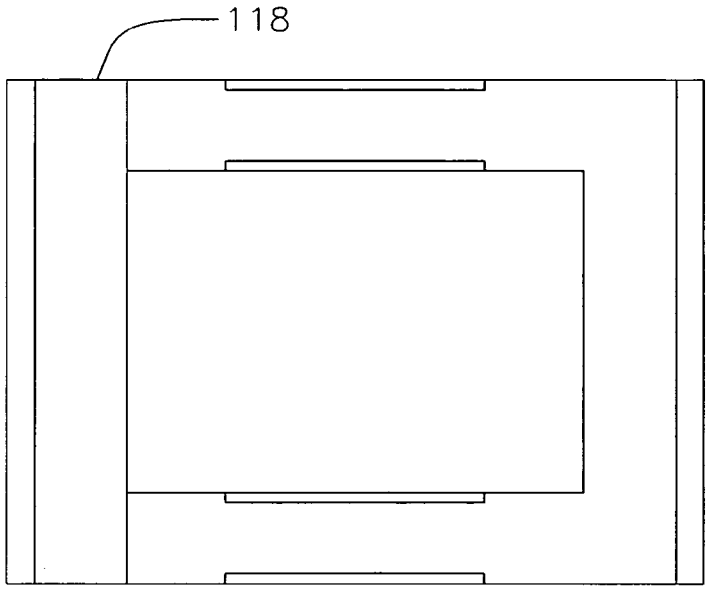
FIG. 9D is an assembled overhead view of a "U" shaped locking bar assembly according to one embodiment of the invention.
Figure 9E:
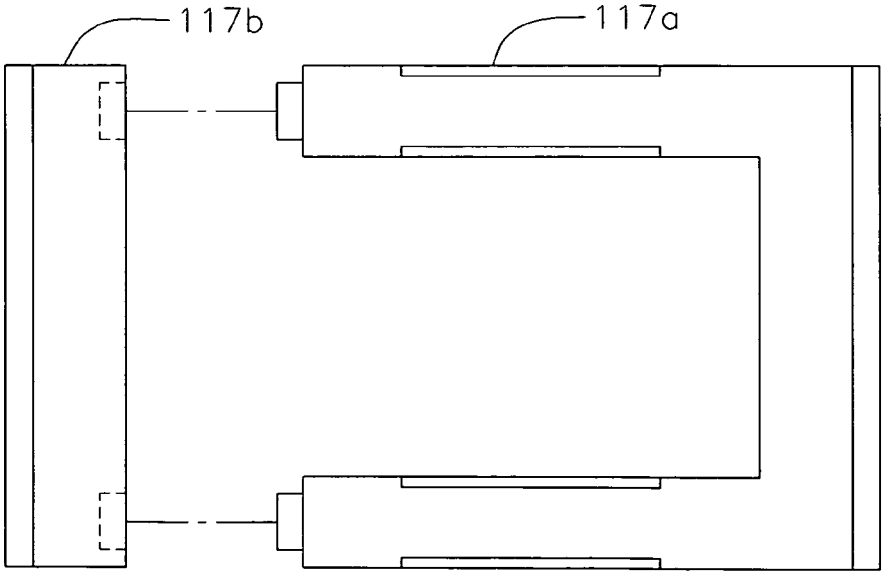
FIG. 9E is an exploded view of a "U" shaped locking bar assembly according to one embodiment of the invention.

FIGS. 9A and 9B show one embodiment of the invention using L-shaped locking bars 114*a,b*. The L-shaped locking bars 114*a,b* engage with one another after being inserted through slots 127, to form a rectangular structure with a solid engaging bar 116. As seen in FIG. 9B, the assembled L-shaped locking bars 116 allow for one handed operation when installing the vertical fore grip 100 to a firearm rail. The assembled vertical fore grip 100 may also have a threaded cap 112, and a pressure switch filler panel 113. In one embodiment, one of the locking bars may also be in the shape of a "U" 117*a* as shown in FIGS. 9C-E. When a "U" shaped locking bar 117*a* is used, after inserting the "U" shaped locking bar 117*a* through the slots in the grip, a single, locking cross bar 117*b* is attached to 117*a* to form a completed assembly 118.

Figure 10:
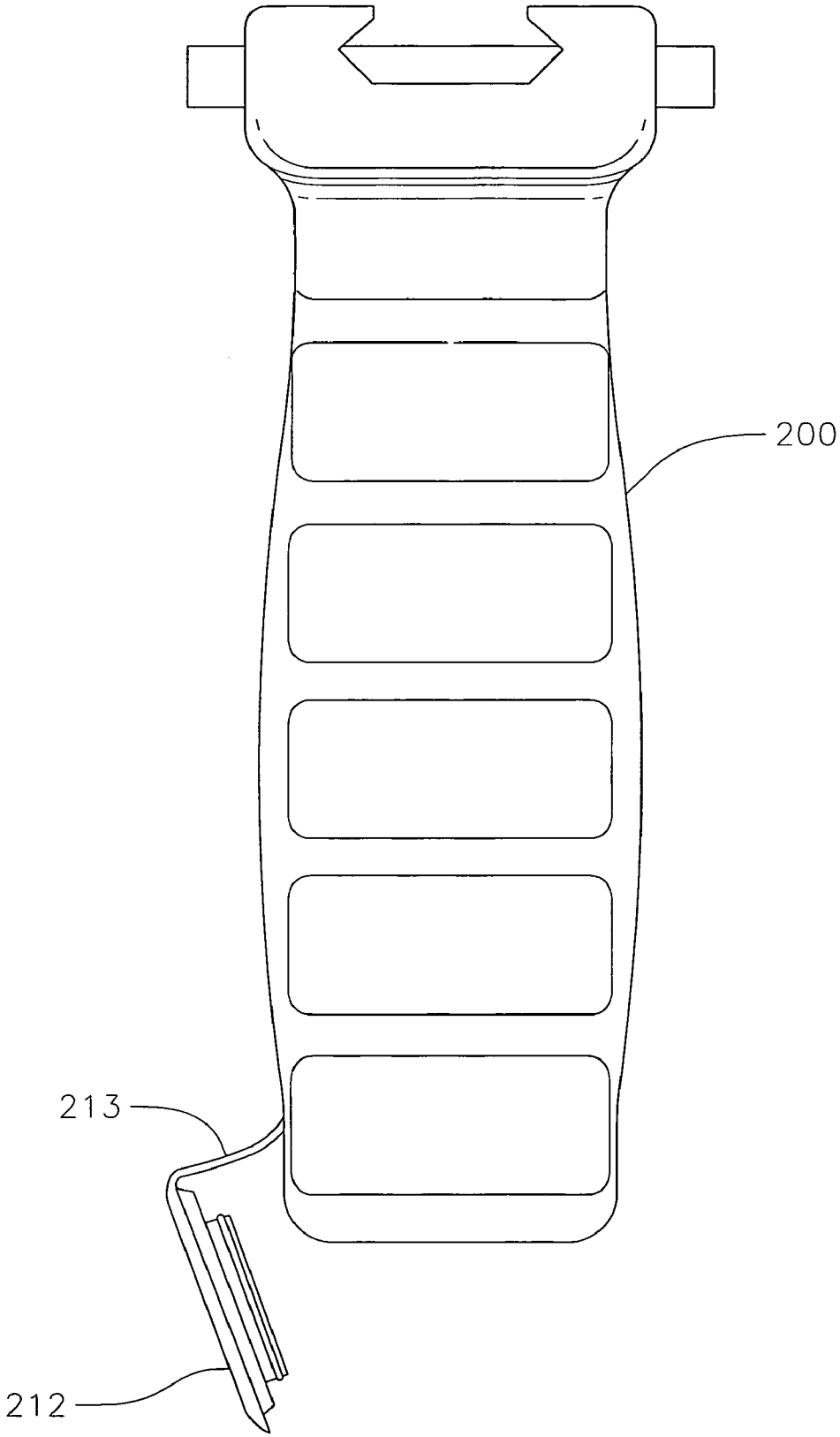
FIG. 10 is a front view of the vertical fore grip with a snapping cap according to one embodiment of the invention.

FIG. 10 shows one embodiment of the invention with a snap-on end cap 212 with tether 213, at the bottom of the vertical fore grip 200. In another embodiment, any of the caps described above may have a tether where one end of the tether may be attached to body, in the internal cavity, and the other end to the removable cap, thus allowing the tether to be stored inside the internal cavity when the cap is installed.

In one embodiment, vertical fore grip has internal storage for spare firearm bolt assemblies, extra batteries, medical supplies or any other mission specific items. The threaded end cap has a large diameter O-ring to make the cavity waterproof. The cap is optionally leashed to the body to prevent its loss.

Materials useful for the fore grip of the present invention include plastics, polymers and metals. In one embodiment, nylon resins are used for the fore grip body and heat-treated stainless steel is used for the spring, and rubber for the O-ring. However, different metals may be used for the spring and different rubber or polymer compounds may be used for the O-ring. In another embodiment, the nylon resin used for the fore grip body is available from Entec Co. as 2033 STHL and the nylon resin used for the locking bars and filler panel is also from Entec Co. as 2043 STHL, which has more glass fibers.

The preceding description has been presented with reference to various embodiments of the invention. Persons skilled in the art and technology to which this invention pertains will appreciate that alterations and changes in the described structures and methods of operation can be practiced without meaningfully departing from the principle, spirit and scope of this invention.

What is claimed is:

1. A fore grip for attachment to a firearm, the fore grip comprising:

a body defining an internal storage cavity with an external opening;

a mount adapted to secure the fore grip to such firearm, the mount located at one end of the body;

a pocket adapted to receive a pressure switch on a perimeter of the body; and a removable cap, adapted to cover the external opening, wherein the mount comprises:

a rail groove;

at least one locking bar dimensioned to interface with cross cuts in a firearm rail;

a spring engaging the body and the at least one locking bar; and at least one slot having an upper portion and a lower portion, the at least one slot dimensioned to accept the at least one locking bar positionable substantially in the upper portion of the at least one slot to engage and lock the fore grip to the firearm and movable in a direction away from the upper portion of the at least one slot to a separate position substantially in the lower portion of the at least one slot to release the fore grip from the firearm, the at least one slot extending through the mount and running through the rail groove substantially perpendicular to the rail groove.

2. The fore grip of claim 1, comprising at least two slots and two locking bars, wherein a distance between the locking bars is adapted to allow the locking bars to interface with corresponding cross cuts in such firearm rail.

3. The fore grip of claim 2, wherein the firearm rail is a Mil-Std 1913 rail.

4. The fore grip of claim 1, wherein the at least one slot comprises a recess where the at least one slot exits the mount, the recess beginning at the top of the body and continuing to the lower portion of the at least one slot.

5. The fore grip of claim 1, wherein the at least one locking bar is rectangular in shape with sloped ends, the ends comprising horizontal ridges to allow a better gripping surface.

6. The fore grip of claim 5, wherein the at least one locking bar further comprises at least one notch along the bottom surface dimensioned to accept the spring.

7. The fore grip of claim 2, wherein both locking bars are configured to operate simultaneously.

8. A fore grip for attachment to a firearm, the fore grip comprising:

a body defining an internal storage cavity with an external opening;

a mount adapted to secure the fore grip to such firearm, the mount located at one end of the body, the mount including:

a rail groove;

two locking bars dimensioned to interface with cross cuts in a firearm rail;

a spring engaging the body and the locking bars; and two slots having an upper portion and a lower portion, each slot dimensioned to accept one of the locking bars positionable substantially in the upper portion of the slot to engage and lock the fore grip to the firearm and movable in a direction away from the upper portion of the slot to a separate position substantially in the lower portion of the slot to release the fore grip from the firearm, the slots extending through the mount and running through the rail groove substantially perpendicular to the rail groove, wherein a distance between the locking bars is adapted to allow the locking bars to interface with corresponding cross cuts in such firearm rail;

a pocket adapted to receive a pressure switch on a perimeter of the body; and a removable cap, adapted to cover the external opening, wherein the removable cap is adapted to prevent such pressure switch from sliding from the fore grip.

* * * * *